US009202610B2

(12) United States Patent
Gould et al.

(10) Patent No.: US 9,202,610 B2
(45) Date of Patent: Dec. 1, 2015

(54) CABLE COMPONENT WITH NON-FLAMMABLE MATERIAL

(71) Applicant: General Cable Technologies Corporation, Highland Heights, KY (US)

(72) Inventors: Robert S. Gould, Cincinnati, OH (US); David M. Fausz, Fort Thomas, KY (US); David P. Camp, II, Florence, KY (US); Scott M. Brown, Independence, KY (US); Brian P. Skocypec, North Attleboro, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 56 days.

(21) Appl. No.: 13/707,077

(22) Filed: Dec. 6, 2012

(65) Prior Publication Data

US 2013/0161063 A1 Jun. 27, 2013

Related U.S. Application Data

(60) Provisional application No. 61/567,428, filed on Dec. 6, 2011.

(51) Int. Cl.

| | |
|---|---|
| ***H01B 11/08*** | (2006.01) |
| ***H01B 3/00*** | (2006.01) |
| ***H01B 7/295*** | (2006.01) |

(52) U.S. Cl.

CPC ..... *H01B 11/08* (2013.01); *H01B 3/00* (2013.01); *H01B 7/295* (2013.01)

(58) Field of Classification Search

CPC ..... H01B 11/08; H01B 3/00; H01B 7/295
USPC ..... 174/113 R
See application file for complete search history.

(56) References Cited

U.S. PATENT DOCUMENTS

| | | | | |
|---|---|---|---|---|
| 3,479,446 | A | 11/1969 | Arnaudin, Jr. et al. | |
| 3,634,311 | A * | 1/1972 | Peterson et al. | 524/409 |
| 5,180,890 | A | 1/1993 | Pendergrass et al. | |

(Continued)

FOREIGN PATENT DOCUMENTS

| | | |
|---|---|---|
| KR | 10-2006-0009448 | 2/2006 |
| WO | 2006065497 A1 | 6/2006 |
| WO | 2011094146 A1 | 8/2011 |

OTHER PUBLICATIONS

Kim, Tae Hoon; International Search Report and Written Opinion of the International Searching Authority, issued in International Application No. PCT/US2012/067975; dated as mailed on Apr. 1, 2013; 8 pages.

(Continued)

*Primary Examiner* — William H Mayo, III
*Assistant Examiner* — Krystal Robinson
(74) *Attorney, Agent, or Firm* — Ulmer & Berne LLP

(57) ABSTRACT

A cable component that comprises a main body where at least a part of the main body is formed of an insulation material, and at least one non-flammable portion is disposed in the insulation material of the main body. The non-flammable portion forms at least about 25% by volume of the cable component, is flexible, and reduces the amount of the insulation material of the main body, thereby reducing the fuel load in the cable component.

25 Claims, 3 Drawing Sheets

(56) References Cited

U.S. PATENT DOCUMENTS

| | | | | |
|---|---|---|---|---|
| 5,716,574 | A | 2/1998 | Kawasaki | |
| 5,744,757 | A | 4/1998 | Kenny et al. | |
| 7,208,683 | B2 * | 4/2007 | Clark | 174/110 R |
| 7,244,893 | B2 * | 7/2007 | Clark | 174/113 R |
| 2002/0088642 | A1 | 7/2002 | Caimi | |
| 2003/0159848 | A1 | 8/2003 | Hopkinson et al. | |
| 2004/0216914 | A1 | 11/2004 | Vexler et al. | |
| 2006/0237220 | A1 * | 10/2006 | Leyendecker | 174/113 R |
| 2006/0243477 | A1 | 11/2006 | Jean et al. | |
| 2007/0163800 | A1 | 7/2007 | Clark et al. | |
| 2007/0230879 | A1 | 10/2007 | McAlpine et al. | |
| 2008/0041609 | A1 | 2/2008 | Gareis et al. | |
| 2008/0115958 | A1 * | 5/2008 | Stutzman et al. | 174/113 C |
| 2010/0206609 | A1 | 8/2010 | Glew | |

OTHER PUBLICATIONS

Lehnert, Andreas; Extended European Search Report, including Supplementary European Search Report and European Search Opinion, issued in European Patent Application No. 12856542.1; dated Oct. 5, 2015; 5 pages.

* cited by examiner

CABLE COMPONENT WITH NON-FLAMMABLE MATERIAL

REFERENCE TO RELATED APPLICATIONS

The present application claims benefit of U.S. Provisional Patent Application No. 61/567,428, filed Dec. 6, 2011. The disclosure of the above-referenced application is hereby incorporated by reference into the present application in its entirety.

FIELD OF THE INVENTION

The present invention relates to components for cables, such as riser and plenum cables, that include non-flammable material, such as fiberglass, for flame and burn resistance.

BACKGROUND OF THE INVENTION

Conventional communication cables for both riser and plenum applications typically include a number of insulated conductors that are twisted together in pairs 100 and surrounded by an outer jacket 102, as seen in FIG. 1. Crosstalk or interference often occurs because of electromagnetic coupling between the twisted pairs within the cable or other components in the cable, thereby degrading the cable's electrical performance. Also, as networks become more complex and have a need for higher bandwidth cabling, reduction of cable-to-cable crosstalk (alien crosstalk) becomes increasingly important.

Barriers or separators, such as the separator 110 shown in FIG. 1, are often used, particularly in plenum applications, to separate and isolate the pairs of conductors, thereby reducing crosstalk interference. Such barriers and separators are normally made of a flame retardant insulation material or insulation materials that meet cable burn tests, such as fluoropolymers like FEP in the case of plenum cables tested per the requirements of NFPA 262 and flame retardant polyolefins in the case of riser cables which are tested per UL 1666. In other applications, such barriers also need to meet requirements for standards such as tests for Low-Smoke, Zero-Halogen or other burn tests similar to UL 1666 or NFPA 262.

However, such flame retardant insulative materials are typically halogenated and release toxic halogens when burned. Fluoropolymers in particular melt and drip when burned. Also, fluoropolymers are typically more expensive due to high demand.

Therefore, a need exists for cable components that meet industry standard burn requirements and that are less toxic and less expensive.

SUMMARY OF THE INVENTION

Accordingly, the present invention provides a cable component that comprises a main body where at least a part of the main body is formed of an insulation material, and at least one non-flammable portion is disposed in the insulation material of the main body. The non-flammable portion forms at least about 25% by volume of the cable component, is flexible, and reduces the amount of the insulation material of the main body, thereby reducing the fuel load in the cable component.

The present invention also relates to a cable that comprises a plurality of twisted pairs of insulated conductors and a separator that is configured to separate the plurality of twisted pairs of insulated conductors. The separator includes a main body that has channels which each retain one of the plurality of twisted pairs of insulated conductors, respectively. The main body is formed of an insulation material that is flame retardant. At least one non-flammable portion is disposed in the insulation material of the main body. The at least one non-flammable portion reduces the amount of the insulation material of the main body, thereby reducing the fuel load of the separator. An outer jacket surrounds the plurality of twisted pairs of insulated conductors and the separator.

The present invention also provides a cable that comprises a plurality of twisted pairs of insulated conductors and a separator that is configured to separate the plurality of twisted pairs of insulated conductors. The separator includes a main body that has channels, each of which retains one of the plurality of twisted pairs of insulated conductors. The main body is formed of a highly flame retardant insulation material. A plurality of flexible fiberglass portions are disposed in the insulation material of the main body. The plurality of flexible fiberglass portions reduce the amount of the insulation material of the main body, thereby reducing the fuel load of the separator. An outer jacket surrounds the plurality of twisted pairs of insulated conductors and the separator, such that the flexible fiberglass portions form at least about 25% by volume of said separator.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF THE INVENTION

Figure 1:
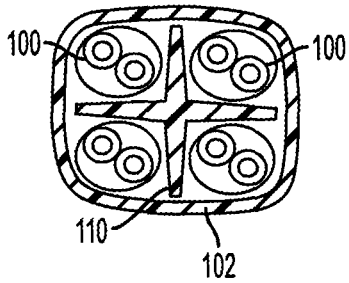
FIG. 1 PRIOR ART
FIG. 1 is a cross-sectional view of a prior art cable and separator.

Referring to FIGS. 2, 3, 4A, 4B, and 5-7, a cable component, such as a separator, according to exemplary embodiments of the present invention, incorporates a non-flammable material, such as fiberglass, therein to provide improved burn properties and heat resistance to the cable component. The non-flammable material may be individual glass fibers bunched together, fiberglass yarns, fiberglass rovings, chopped fiberglass, woven fiberglass tapes or sheets, and the like. These materials are desirable because they have optimal burn properties while also allowing the cable component to maintain flexibility. Other suitable non-flammable materials can also be employed, such as basalt fibers, yarns, woven tapes, high temperature ceramic oxide fibers, other ceramic mica tapes, and the like. These materials are desirable because of their high temperature performance in cable applications. The non-flammable material replaces and thus reduces the amount of the fuel burning materials, such as FEP or polyolefin, of the separator, thereby improving the burn performance of the separator. The separators of the exemplary embodiments are preferably at least about 25% by volume non-flammable material.

In the case of plenum applications in particular, halogenated fluoropolymers of the cable component are displaced by the non-flammable material without sacrificing burn performance. That significantly reduces the content of costly and potentially hazardous halogenated materials in the cable. Also, many fluoropolymers when under extreme heat tend to melt and drip onto surfaces where they continue to smoke rather than burn cleanly. The non-flammable material, e.g. fiberglass, which replaces at least a portion of the fluoropolymers, limits the amount of molten material that can drip from the cable and smoke when heated. Also, in the present invention, it is possible to construct a flame retardant polyolefin separator in plenum applications by incorporating the non-flammable material therein to provide improved burn properties and heat resistance. Typically flame retardant polyolefins cannot be used for plenum applications to meet standard requirements because they typically tend to allow more flame spread than fluoropolymers. However, because the non-flammable material significantly reduces the amount of flame retardant polyolefin that would be needed in the cable component, it is now possible to use the lower cost non-fluoropolymer materials, such as polyolefin, and still maintain the smoke and flame spread performance required to meet the NFPA 262 tests. Furthermore, it is also possible with the present invention to construct a low-smoke, zero-halogen plenum grade pair separator and still meet the requirements of the NFPA 262 test.

In the case of riser applications where the requirements mandate limited vertical flame spread, burn performance of the cable component can be significantly improved by the addition of the non-flammable material according to the present invention. And because of the excellent burn properties of fiberglass, for example, the amount of flame retardants needed to meet requirements for riser applications is significantly reduced. In general, the excellent burn properties of the fiberglass also exceed those of the flame-retardant polyolefins, thereby improving overall performance in the riser burn test. Also, because of the reduction in fuel load resulting from displacing polymer material in the separator with the non-flammable material, like fiberglass, flame retardants elsewhere in the cable can be reduced. That allows for a reduction in the amount of flame retardants used in the outer jacket and insulation materials as well as other cable components, such as barrier tapes in shielded cables.

Figure 2:
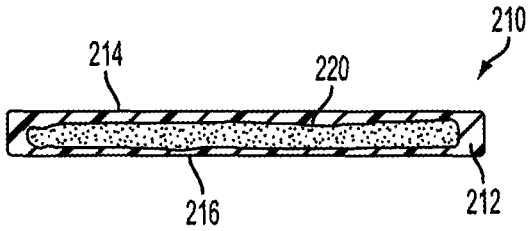
FIG. 2 is a cross-sectional view of a cable component according to a first exemplary embodiment of the present invention.

FIG. 2 illustrates a cable component or separator 210 according to a first exemplary embodiment of the invention. The separator 210 acts to isolate the pairs 100 in the cable. As an example, one or more pairs 100 may be located in the cable adjacent on one side 214 of the separator 210 and one or more pairs 110 may be located adjacent the other side 216 of the separator 210. The separator 210 has a main body 212 that is substantially flat. For example, the separator's main body 212 may be a tape. The main body 212 is preferably made of an insulation material, such as a flame retardant polymer, like FEP or a highly flame retardant halogen-free polyolefin. Incorporated in the main body 212 is the non-flammable material or portion 220 that preferably extends for the length of the separator. The non-flammable portion 220 is preferably flexible. For example, the non-flammable material 220 may be formed of a plurality of strands, such as fiberglass, that displace a portion of the insulation material of the main body 212 while maintaining the flexibility of the separator 210. As seen in FIG. 2, the non-flammable portion 220 is about 80% of the separator 210.

Figure 3:
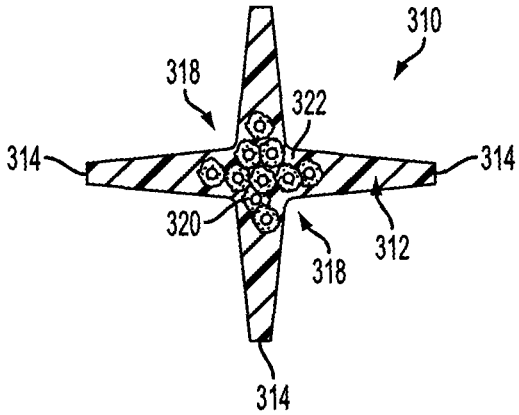
FIG. 3 is a cross-sectional view of a cable component according to a second exemplary embodiment of the present invention.

As seen in FIG. 3, a cable component or separator 310 according to a second exemplary embodiment of the present invention may be used to separate the pairs 100 of the cable similar to the separator 110 of FIG. 1. The separator 310 has a main body 312 with a generally cross-web shape in cross-section that includes a plurality of arms 314. The arms 314 extend from a center 322 of the separator 310 and may taper. Channels 318 are defined between the arms 314 for receiving the pairs 100. Like the separator of the first embodiment, the main body 312 is preferably made of an insulation material. Provided in the center 322 of the separator 310 is the non-flammable portion 320 that preferably extends for the length of the separator. The non-flammable portion 320 may be, for example, a plurality of bundles of strands, such as fiberglass strands. The non-flammable portion 320 also preferably forms about 50% by volume of the separator 310.

Figure 4A:
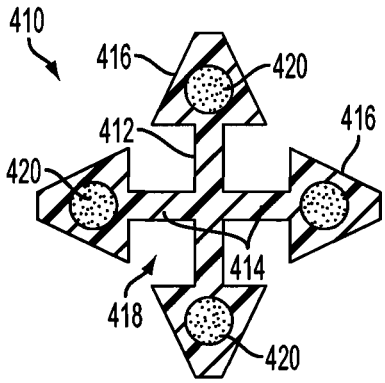
FIG. 4A is a cross-sectional view of a cable component according to a third exemplary embodiment of the present invention.
Figure 4B:
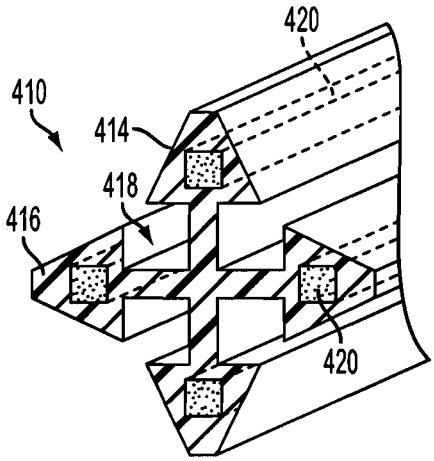
FIG. 4B is a partial perspective view of the cable component illustrated in FIG. 4A.

As seen in FIGS. 4A and 4B, a cable component or separator 410 according to a third embodiment of the present invention has a main body 412 with a generally cross-web shape in cross-section that includes a plurality of arms 414. The main body 412 is preferably made of a flame retardant insulation material similar to the first and second embodiments.

Each arm 414 of the separator 410 preferably has an enlarged end section 416. The enlarged end sections 416 may have any cross-sectional shape, such as triangular, as seen in FIG. 4A. Channels 418 are defined between the enlarged end sections 416 and the arms 414 that are configured to individually receive the pairs 100. Disposed in each end section 416 may be a non-flammable portion 420. The non-flammable portions 420 extend through the length of the separator 210, as seen in FIG. 4B. Each non-flammable portion 420 may have any cross-sectional shape, such as substantially circular (FIG. 4A) or substantially square (FIG. 4B). Although it is preferable that each end section 416 of the arms 414 includes the non-flammable portion 420, any number of the end sections 416 may have the non-flammable portion 420 including just one end section 416.

Figure 5:
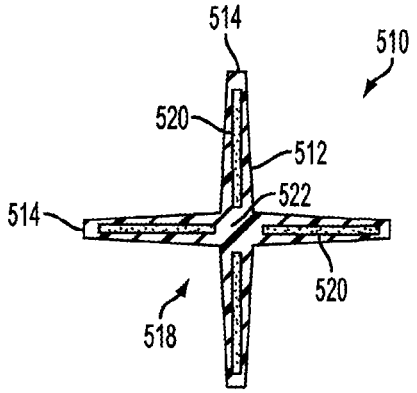
FIG. 5 is a cross-sectional view of a cable component according to a fourth exemplary embodiment of the present invention.

As seen in FIG. 5, a cable component 510 according to a fourth exemplary embodiment of the present invention is a separator that includes a main body 512 that has a substantially cross-web shape in cross-section. The main body 512 is preferably made of a flame retardant polymer like previous embodiments and includes a plurality of arms 514. The arms 514 extend from a center 522 of the separator and may taper. Channels 518 are defined between the arms 514 for receiving the pairs 100.

Each arm 514 of the separator 510 may have a non-flammable portion 520 extending for the length of the separator, similar to the non-flammable portions 220 of the first embodiment. Each non-flammable portion 520 preferably has a generally flat shape that is substantially linear in cross-section, as seen in FIG. 5. Each non-flammable portion 520 preferably extends approximately the width of each arm 514, leaving the center 522 of the separator free of the non-flammable material. However, any portion of the arms 514 may include the non-flammable portion 520. Alternatively, the non-flammable portion 520 may also be added to the center 522 of the separator. For example, one non-flammable portion 520 may span across two arms 514 and through the center 522. Although it is preferable that each arm 514 include its own non-flammable portion 520, any number of the arms 514 may include the non-flammable portion 520, including just one arm 514.

Figure 6:
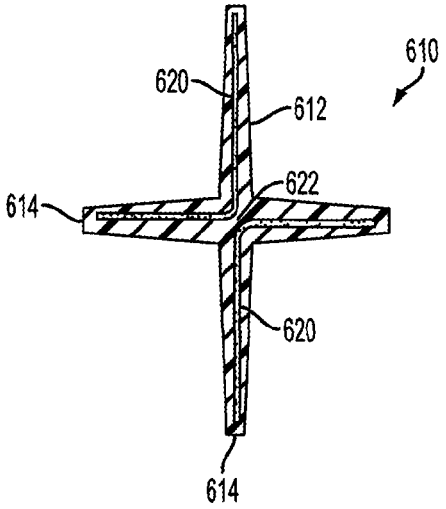
FIG. 6 is a cross-sectional view of a cable component according to a fifth exemplary embodiment of the present invention.

As seen in FIG. 6, a cable component or separator 610 according to a fifth exemplary embodiment of the present invention is similar to the separator 510 of the fourth embodiment, except that the non-flammable portions 620 span more than one arm 614 of the separator 610. Like the separator 510 of the fourth embodiment, the separator 610 of the fifth embodiment has a main body 612 with a cross-web shape that includes a plurality of arms 614. Non-flammable portions 620 are each disposed in two of the arms 614 and the center 622 of the separator, such that each portion 620 has a substantially L-shape in cross-section, as seen in FIG. 6. Each non-flammable portion 620 preferably extends for the length of the separator 610. Although it is preferable to use at least two non-flammable portions 620, as illustrated in FIG. 6, only one non-flammable portion 620 may be used.

Figure 7:
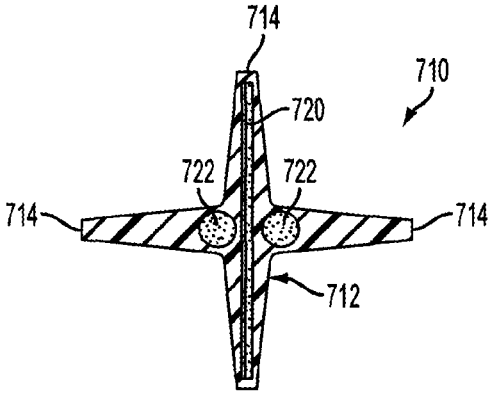
FIG. 7 is a cross-sectional view of a cable component according to a sixth exemplary embodiment of the present invention.

As seen in FIG. 7, a cable component or separator 710 according to a sixth exemplary embodiment of the present invention combines aspects of the previous embodiments. In particular, the separator 710 has a generally cross-web shape similar to the second, fourth and fifth embodiments. The separator 710 has a main body 712 that incorporates non-flammable portions 720 and 722. The non-flammable portion 720, for example, may be generally flat with a substantially linear cross-section that spans two arms 714 of the main body 712. On either side of the flat non-flammable portion 720 may be non-flammable portions 722 that preferably form bundles of fibers or strands woven into a flat fabric and folded into L-shape then disposed in the other two arms of the separator 710. As with the other embodiments, the non-flammable portions 720 and 722 are preferably flexible and not rigid.

While particular embodiments have been chosen to illustrate the invention, it will be understood by those skilled in the art that various changes and modifications can be made therein without departing from the scope of the invention as defined in the appended claims. For example, any separator may incorporate the non-flammable material or portion as taught by the present invention and are not limited to the embodiments described above. Additionally, any combination of the above non-flammable portions may be incorporated into the separator. Also, other cable components, such as barriers, wraps and fillers, may incorporate fiberglass, as taught by the present invention.

What is claimed is:

1. A cable component, comprising:

a main body, at least a part of the main body comprising:

an insulation material; and one or more non-flammable portions formed of a non-fluoropolymer material, the one or more non-flammable portions disposed within the insulation material; and wherein the one or more non-flammable portions comprise about 25% or more, by volume, of the cable component, is flexible, and reduces the quantity of insulation material of the main body.

2. The cable component of claim 1, wherein the one or more non-flammable portions comprise fiberglass, bunched fiberglass fibers, fiberglass yarn, fiberglass rovings, chopped fiberglass, woven fiberglass, basalt fibers, yarn, woven tape, or ceramic oxide fibers.

3. The cable component of claim 1, wherein the main body comprises a plurality of arms, and the one or more non-flammable portions are disposed in one or more of the plurality of arms.

4. The cable component of claim 1, wherein the main body comprises a plurality of arms, and the one or more non-flammable portions are disposed in two of the plurality of arms.

5. The cable component of claim 1, wherein the main body comprises a plurality of non-flammable portions, and the plurality of non-flammable portions comprise about 30% or more, by volume, of the cable component.

6. The cable component of claim 5, wherein each of the plurality of non-flammable portions has a substantially linear cross-sectional shape.

7. The cable component of claim 5, wherein one or more of the plurality of non-flammable portions have a substantially linear cross-sectional shape, and one or more of the plurality of non-flammable portions comprise a bundle of fibers.

8. The cable component of claim 5, wherein the plurality of non-flammable portions have either a substantially circular cross-sectional shape or a substantially square cross-sectional shape.

9. The cable component of claim 5, wherein the main body comprises a plurality of arms, each of the plurality of arms includes an enlarged end section, wherein the plurality of non-flammable portions are disposed in the enlarged end sections.

10. The cable component of claim 1, wherein the one or more non-flammable portions have a substantially L-shaped cross-sectional shape.

11. The cable component of claim 1, wherein the insulation material comprises a highly flame retardant halogen free polyolefin.

12. The cable component of claim 11, wherein the main body is substantially free of halogenated materials.

13. The cable component of claim 1, wherein the main body is a tape.

14. The cable component of claim 1, wherein the one or more non-flammable portions comprise a bundle of fiberglass fibers; and the one or more non-flammable portions are disposed near a center of the main body.

15. A cable, comprising:

a plurality of twisted pairs of insulated conductors;

a separator configured to separate the plurality of twisted pairs of insulated conductors, the separator comprising, a main body having channels for retaining the plurality of twisted pairs of insulated conductors, the main body comprising a flame retardant insulation material, and one or more non-flammable portions formed from a non-fluoropolymer material, the one or more non-flammable portions disposed within the insulation material, and wherein the one or more non-flammable portions comprise about 25% or more, by volume, of the separator and reduce the quantity of the insulation material; and an outer jacket surrounding the plurality of twisted pairs of insulated conductors and the separator.

16. The cable of claim 15, wherein the one or more non-flammable portions comprise fiberglass, bunched fiberglass fibers, fiberglass yarn, fiberglass rovings, chopped fiberglass, woven fiberglass, basalt fibers, yarn, woven tape, or ceramic oxide fibers.

17. The cable of claim 15, wherein the main body comprises a plurality of arms, and the one or more non-flammable portions are disposed in one or more of the plurality of arms.

18. The cable of claim 15, wherein the plurality of non-flammable portions comprising one of a substantially linear cross-sectional shape and a bundle of fibers.

19. The cable of claim 15, wherein the plurality of non-flammable portions have either a substantially circular cross-sectional shape or a substantially square cross-sectional shape.

20. The cable of claim 15, wherein the main body includes a plurality of arms, each of the plurality of arms comprises an enlarged end section, and each of the plurality of non-flammable portions is disposed in the enlarged end sections.

21. The cable of claim 15, wherein the non-flammable portions comprise a substantially L-shaped cross-sectional shape.

22. The cable of claim 15, wherein the insulation material is a highly flame retardant halogen free polyolefin.

23. The cable of claim 15, wherein the main body is a tape.

24. The cable of claim 15, wherein the main body of the separator is a cross-web with four arms;

the main body comprises a plurality of non-flammable portions; and one or more of the plurality of non-flammable portions are disposed in each of the four arms.

25. A cable, comprising:

a plurality of twisted pairs of insulated conductors;

a separator configured to separate the plurality of twisted pairs of insulated conductors, the separator comprising, a main body, the main body comprising channels for retaining the plurality of twisted pairs of insulated conductors and being comprised of a highly flame retardant insulation material, a plurality of flexible, non-fluoropolymer fiberglass portions disposed within the main body, the plurality of flexible, non-fluoropolymer fiberglass portions reducing the amount of the highly flame retardant insulation material; and an outer jacket surrounding the plurality of twisted pairs of insulated conductors and the separator, and wherein the flexible, non-fluoropolymer fiberglass portions form about 25% or more, by volume, of the separator.

* * * * *

UNITED STATES PATENT AND TRADEMARK OFFICE

CERTIFICATE OF CORRECTION

PATENT NO. : 9,202,610 B2
APPLICATION NO. : 13/707077
DATED : December 1, 2015
INVENTOR(S) : Robert S. Gould et al.

It is certified that error appears in the above-identified patent and that said Letters Patent is hereby corrected as shown below:

IN THE SPECIFICATION

Column 4, line 42, change "separator 210" to --separator 410--.

Signed and Sealed this
Fifteenth Day of March, 2016

Michelle K. Lee

Michelle K. Lee
*Director of the United States Patent and Trademark Office*